United States Patent [19]

Kasama et al.

[11] Patent Number: 4,999,275

[45] Date of Patent: Mar. 12, 1991

[54] SILVER HALIDE PHOTOGRAPHIC LIGHT-SENSITIVE MATERIAL

[75] Inventors: Yasuo Kasama; Nobuaki Inoue, both of Kanagawa, Japan

[73] Assignee: Fuji Photo Film Co. Ltd., Tokyo, Japan

[21] Appl. No.: 325,945

[22] Filed: Oct. 15, 1986

Related U.S. Application Data

[63] Continuation of Ser. No. 673,642, Nov. 21, 1984, abandoned.

[30] Foreign Application Priority Data

Nov. 22, 1983 [JP] Japan ..... 58-219800

[51] Int. Cl.[5] ..... G03C 1/30; G03C 1/06

[52] U.S. Cl. ..... 430/264; 430/539; 430/599; 430/949; 430/961

[58] Field of Search ..... 430/264, 605, 599, 949, 430/961, 539

[56] References Cited

U.S. PATENT DOCUMENTS 4,272,606 6/1981 Mifune et al. .

4,459,347 7/1984 Parton et al. ..... 430/605

FOREIGN PATENT DOCUMENTS 2101758 1/1983 United Kingdom .

OTHER PUBLICATIONS

Research Disclosure, Dec. 1978, pp. 22–31, Abst. No. 17643.

*Primary Examiner*—Paul R. Michl

*Assistant Examiner*—Thori Chea

*Attorney, Agent, or Firm*—Sughrue, Mion, Zinn Macpeak & Seas

[57] ABSTRACT

A silver halide photographic light-sensitive material is described, comprising a support, at least one light-sensitive silver halide emulsion layer on the support, and at least one light-insensitive top layer provided on the emulsion layer, wherein at least one of the emulsion layer and other constituent layers contains a compound represented by the general formula (I)

$$R^1—NHNH—G—R^2 \quad (I)$$

wherein $R^1$ is a substituted or unsubstituted aryl group, $R^2$ is a hydrogen atom, a substituted or unsubstituted aryl group, a substituted or unsubstituted alkyl group, a substituted or unsubstituted alkoxy group, or a substituted or unsubstituted aryloxy group, and G is a carbonyl group, a sulfonyl group, a sulfoxy group, a phosphoryl group, or an N-substituted or unsubstituted imino group and wherein said at least one light-insensitive top layer is hardened so as to have a melting time at least 50 seconds longer than that of the emulsion layer. This material enables the formation of a negative image having super contrast with a stable processing solution.

6 Claims, No Drawings

SILVER HALIDE PHOTOGRAPHIC LIGHT-SENSITIVE MATERIAL

This is a continuation of application Ser. No. 673,642 filed Nov. 21, 1984, now abandoned.

FIELD OF THE INVENTION

The present invention relates to a silver halide photographic light-sensitive material. More particularly, it is concerned with a silver halide photographic light-sensitive material which permits rapid formation of a super contrast negative image useful for photomechanical process, using a stable processing solution.

BACKGROUND OF THE INVENTION

Photomechanical process needs an image-forning system producing super contrast photographic characteristics (particularly photographic characteristics in which the gamma is at least 10) for good reproduction of continuous gradation or line images by means of dot images.

For this purpose, a hydroquinone developer (or an infectious developer) has been generally used in which the effective concentration of sulfite ions is greatly reduced, usually to not more than 0.1 mol per liter of the developer. This method, however, suffers from a serious problem in that the stability of the developer is poor because of its low sulfite ion concentration and therefore cannot be stored stably for more than 3 days.

U.S. Pat. No. 2,419,975 discloses that a high contrast negative image can be obtained by adding certain hydrazine compounds to a silver halise emulsion However, when super contrast photographic characteristics wherein the gamma is at least 10 are intended to be obtained using the hydrazine compounds disclosed in the above U.S. Pat. No. 2,419,975, it is necessary to use a developer having a pH as high as 12.8. Such strongly alkaline developers having a pH near 13 are liable to be oxidized by air and thus cannot be stored stably or used over long periods of time. Of course, the storage stability can be improved by increasing the amount of sulfite ions added. However, to sufficiently improve the stability of a developer having such a high pH, it is necessary to add a large amount of sulfite. This not only causes contamination of the processing solution, but also produces a serious problem in that the formation of images of high contrast is prevented.

It has therefore been desired to develop an image-forming system which enables the production of a super contrast image using a processing solution with increased stability.

Under such circumstances, U.S. Pat. Nos. 4,224,401, 4,168,977, 4,311,781, 4,272,606, 4,221,857, and 4,243,739 disclose a system whereby a super contrast negative image having a gamma in excess of 10 is formed by processing a surface latent image-type silver halide photographic light-sensitive material with specific hydrazine compounds added thereto with a stable developer containing not less than 0.15 mol/liter of sulfite ions and having a pH of from 11 to 12.3.

This system, however, still has various problems For example, a relatively long processing time is needed to obtain the desired photographic performance (i.e., the developing speed is low), and the photographic characteristics vary considerably depending on the developing time and the developing temperature (i.e., the developing latitude is narrow) Therefore, it has been desired to further improve the system to attain the object that the photographic characteristics of super contrast and high sensitivity characteristic of the system are realized by a rapid processing and further with a broad developing latitude

SUMMARY OF THE INVENTION

The object of the present invention is to provide a silver halide photographic light-sensitive material which permits the obtainment of photographic characteristics of high sensitivity, super contrast wherein the gamma is in excess of 10, and negative gradation using a stable developer, rapidly and further with a broad developing latitude.

These and other objects have been attained by providing a silver halide photographic light-sensitive material comprising a support, at least one light-sensitive silver halide emulsion layer on the support, and at least one light-insensitive top layer provided on the emulsion layer, wherein at least one of the emulsion layers and other constituent layers contains a compound represented by the general formula (I)

$$R^1—NHNH—G—R^2$$

wherein $R^1$ is a substituted or unsubstituted aryl group, $R^2$ is a hydrogen atom, a substituted or unsubstituted aryl group, a substituted or unsubstituted alkyl group, a substituted or unsubstituted alkoxy group, or a substituted or unsubstituted aryloxy group, and G is a carbonyl group, a sulfonyl group, a sulfoxy group, a phosphoryl group, or an N-substituted or unsubstituted imino group and wherein said at least one light-insensitive top layer is hardened so as to have a melting time which is at least 50 seconds longer than that of the emulsion layer.

DETAILED DESCRIPTION OF THE INVENTION

Hardening the light-insensitive top layer so as to have a melting time which is longer than that of the emulsion layer is, as described in Japanese Patent Application (OPI) No. 42039/83 (the term "OPI" as used herein means a "published unexamined Japanese patent application"), useful for reduction of line or dot images formed in a silver halide photographic light-sensitive material for photomechanical process, more specifically effective in providing anisotropy to the direction of permeation of a reducing solution through the silver image to thereby increase the ratio of a decrease in image area to the decrease in image density, i.e., the reduction width.

Thus the silver halide photographic light-sensitive material for photomechanical process of the present invention is very suitable for the reduction treatment. More astonishingly, provision of such a light-insensitive top layer hardened so as to have a melting time which is longer than that of the emulsion layer improves the developing properties of the silver halide photographic light-sensitive material, thereby permitting the attainment of the photographic characteristics of high sensitivity and high gamma, which are characteristic of the light-sensitive material, and further improving the developing latitude of the light-sensitive material This is an unexpected effect which could not be anticipated from the prior art findings.

The present invention will hereinafter be explained in detail.

The hydrazine compounds to be used in the emulsion layer or other constituent layers made of hydrophilic colloid are represented by the following general formula (I):

$$R^1—NHNH—G—R^2$$

wherein $R^1$ is a substituted or unsubstituted aryl group, $R^2$ is a hydrogen atom, a substituted or unsubstituted alkyl group, a substituted or unsubstituted aryl group, a substituted or unsubstituted alkoxy group, or a substituted or unsubstituted aryloxy group, and G is a carbonyl group, a sulfonyl group, a sulfoxy group, a phosphoryl group, or an N-substituted or unsubstituted imino group.

The substituted or unsubstituted aryl group represented by $R^1$ in the general formula (I) is a single or double-ring aryl or heteroaryl group. Examples are benzene ring, a naphthalene ring, a pyridine ring, a pyrimidine ring, an imidazole ring, a pyrazole ring, a quinoline ring, an isoquinoline ring, a benzimidazole ring, an indazole ring, a thiazole ring, and a benzothiazole ring. Particularly preferred are those containing a benzene ring.

The aryl group may be substituted. Preferred substituents include a straight, branched or cyclic alkyl group preferably having from 1 to 20 carbon atoms (e.g., a methyl group, an ethyl group, an isopropyl group, and a n-dodecyl group), an aralkyl group, preferably a single or double-ring group in which the number of carbon atoms in the alkyl portion is from 1 to 3 (e.g., a benzyl group), an alkoxy group preferably having from 1 to 20 carbon atoms (e.g., a methoxy group and an ethoxy group), a substituted amino group, preferably substituted with an alkyl group having from 1 to 20 carbon atoms (e.g., a dimethylamino group and a diethylamino group), an aliphatic acylamino group preferably having an alkyl group having from 2 to 21 carbon atoms (e.g., an acetylamino group and a heptylamino group), an aromatic acylamino group, preferably having a single or double-ring aryl group (e.g., a benzoylamino group), and a group represented by $X\text{-}(Y)_n$.

In the above formula $X\text{-}(Y)_n$, n is 0 or 1,

Y is a divalent connecting group, e.g., —CONH—, —$R^{11}$—CONH—, —O —$R^{11}$—CONH—, —S—$R^{11}$—CONH—, —$R^{11}$—, —$R^{11}$—O—$R^{12}$—, —$R^{11}$—S—$R^{12}$, —SO NH—, —$R^{11}$—SO NH—, —NH-CONH—, —CH —CH—N—, —$R^{11}$—NH—, —$R^{11}$—O—$R^{12}$—CONH—, —NHCO—$R^{11}$—, —NH-CO—$R^{11}$—CONH—, and —$R^{11}$—$R^{12}$— (wherein $R^{11}$ and $R^{12}$ may be the same or different and are each a divalent saturated or unsaturated aliphatic group (e.g., an ethylene group, a butenylene group, 1-methylpropylene group, and a 1-methylmethylene group), or a divalent aromatic group which may be substituted with, e.g., an amino group (e.g., a phenylene group, a naphthylene group, and a 5-amino-1,2-phenylene group), provided that in the case of —$R^{11}$—$R^{12}$—, $R^{11}$ and $R^{12}$ are different divalent groups), and X is a group containing a

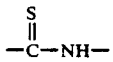

unit, a group containing a

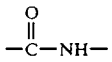

unit, a group represented by

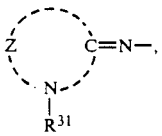

a heterocyclic residue, an aralkyl group (when n=1), or an alkyl-substituted aryl group.

The above heterocyclic residue is a 5- or 6-membered ring containing at least one heteroatom and may be condensed with an aromatic ring, particularly a benzene ring. Preferred examples are monovalent groups of heterocyclic compounds (e.g., 1,2-benztriazole-5-yl, 5-tetrazolyl, indazole-3-yl, 1,3-benzimidazole-5-yl , and hydroxytetrazaindene-2- or -3-yl), monovalent groups of heterocyclic quaternary ammonium salts (e.g., N-ethylbenzthiazolium-2-yl, N-sulfoethylbenzthiazonilium-2-yl, and N,N-dimethylbenzimidazolium-2-yl), and monovalent groups of heterocyclic compounds having a mercapto group (e.g., 2-mercaptobenzthiazole-5- or -6-yl, and 2-mercaptobenzoxazole-5- or -6-yl)

The aralkyl group represented by X is a single or double-ring aralkyl group in which the number of carbon atoms in the alkyl group portion is from 1 to 3. An example is a benzyl group.

An example of the alkyl-substituted aryl group represented by X is a 2,4-di-tert-amyl-1-phenyl group.

Preferred examples of the group containing the

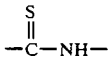

unit are

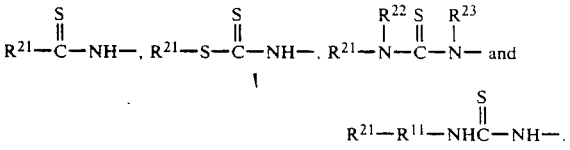

Preferred examples of the group containing the

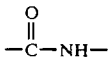

group are

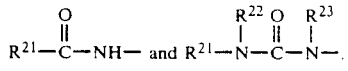

In the above formulae, $R^{21}$ is an aliphatic group (e.g., an alkyl group, a cycloalkyl group, and an alkenyl group), an aromatic group (e.g., a phenyl group and a naphthyl group), or a heterocyclic residue (e.g., a thiazolyl group, a benzothiazolyl group, an imidazolyl group, a thiazolinyl group, a pyridinyl group, and a tetrazolyl group), $R^{22}$ is a hydrogen atom, or an aliphatic or aromatic group as defined for $R^{21}$, $R^{23}$ is a hydrogen atom, or an aliphatic group as defined for $R^{21}$, and $R^{11}$ is the same as defined above, provided that at least one of $R^{22}$ and $R^{23}$ is a hydrogen atom.

$R^{21}$ and $R^{23}$ may combine together to form a ring. Preferred examples of the ring are shown below.

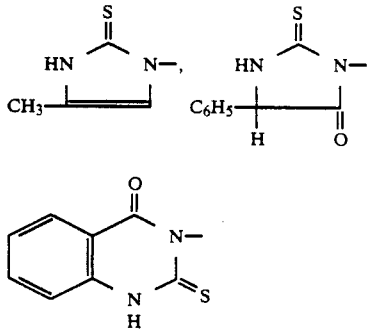

$R^{21}$ and $R^{22}$ may be further substituted with an alkoxy group, an alkoxycarbonyl group, an aryl group, an alkyl group, a dialkylamino group, an alkylthio group, a mercapto group, a hydroxyl group, a halogen atom, a carboxyl group, a nitro group, a cyano group, a sulfonyl group, a carbamoyl group, and the like.

In the group

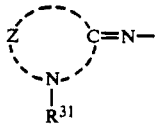

represented by X, Z is a nonmetallic atom group forming a 5- or 6-membered heterocyclic ring in combination with

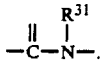

Representative examples of the heterocyclic ring include a thiazoline ring, a benzthiazoline ring, a naphthothiazoline ring, a thiazolidine ring, an oxazoline ring, a benzoxazoline ring, an oxazolidine ring, a selenazoline ring, a benzselenazoline ring, an imidazoline ring, a benzimidazoline ring, a tetrazoline ring, a triazoline ring, a thiadiazoline ring, a 1,2-dihydropyridine ring, a 1,2-dihydroquinoline ring, a 1,2,3,4-tetrahydroquinoline ring, a perhydro-1,3-oxadine ring, a 2,4-benz(d)oxadine ring, a perhydro-1,3-thiazine ring, a 2,4-benz(d)thiazine ring, and a uracyl ring.

$R^{31}$ is a hydrogen atom, or a saturated or unsaturated aliphatic group (e.g., an alkyl group, an alkenyl group, and an alkynyl group), which may be further substituted with an alkoxy group, an alkylthio group, an acylamino group, an acyloxy group, a mercapto group, a sulfo group, a carboxyl group, a hydroxyl group, a halogen atom, an amino group, and the like.

Particularly preferred among the groups represented by X are a group containing a

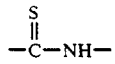

unit a group represented by

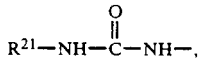

a group represented by

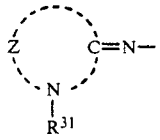

and an alkyl-substituted aryl group (particularly Y =—O—$R^{11}$—CONH—)

The aryl group which may be substituted, as indicated by $R^2$ in the general formula (I) is a single or double-ring aryl group. Examples are a benzene ring and a naphthalene ring. Particularly preferred are those containing a benzene ring. This aryl group may be substituted with groups such as a halogen atom, a cyano group, a carboxyl group, and a sulfo group. Preferred examples of the aryl group represented by $R^2$ are a phenyl group, a 4-chlorophenyl group, a 4-bromophenyl group, a 3-chlorophenyl group, a 4-cyanophenyl group, a 4-carboxyphenyl group, a 4-sulfophenyl group, a 3-5-dichlorophenyl group, and a 2,5-dichlorophenyl group.

The alkyl group which may be substituted, as indicated by $R^2$ in the general formula (I) is preferably an alkyl group having from 1 to 4 carbon atoms. Examples of the substituent are a halogen atom, a cyano group, a carboxyl group, a sulfo group, an alkoxy group, and a phenyl group. Particularly preferred examples of the alkyl group include a methyl group, an ethyl group, a n-propyl group, an i-propyl group, a methoxyethyl group, and a 2-carboxylethyl group.

The alkoxy group which may be substituted, as indicated by $R^2$ in the general formula (I) is an alkoxy group having from 1 to 8 carbon atoms Examples of the substituent are a halogen atom and an aryl group. Examples are a methoxy group, an ethoxy group, a n-propoxy group, an iso-propoxyl group, a butoxy group, an isobutoxy group, a pentachlorobenzyloxy group, and a hexyloxy group.

The aryloxy group which may be substituted, as indicated by $R^2$ in the general formula (I) is preferably a single ring. An example of the substituent is a halogen atom. Examples are a phenoxy group and a 4-chlorophenoxy group.

Preferred examples of the groups represented by $R^2$ are as follows.

When G is a carbonyl group, they include a hydrogen atom, a methyl group, a methoxy group, an ethoxy group, and a substituted or unsubstituted phenyl group, with a hydrogen atom being particularly preferred;

when G is a sulfonyl group, they include a methyl group, an ethyl group, a phenyl group, and a 4-methylphenyl group, with a methyl group being particularly preferred;

when G is a phosphoryl group, they include a methoxy group, an ethoxy group, a butoxy group, a phenoxy group, and a phenyl group, with a phenoxy group being particularly preferred;

when G is a sulfoxy group, they include a cyanobenzyl group and a methylthiobenzyl group; and when G is an N-substituted or unsubstituted imino group, they include a methyl group, an ethyl group, and a substituted or unsubstituted phenyl group, with a methyl group being particularly preferred.

As G, a carbonyl group is most preferred.

Of the compounds represented by the general formula (I), preferred ones are described in, e.g., Japanese Patent Application (OPI) Nos. 10921/78, 20922/78, 66732/78, Japanese Patent Application Nos 125602/78 and 82/79, Japanese Patent Application (OPI) No. 20318/78, and *Research Disclosure*, No. 17626 (No. 176, 1978). Particularly preferred are the compounds described in Japanese Patent Application (OPI) Nos. 10921/78, 20922/78, and 66732/78.

Typical examples of the compounds represented by the general formula (I) are shown below, although the present invention is not limited thereto.

I-1

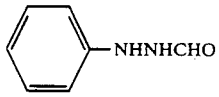

I-2

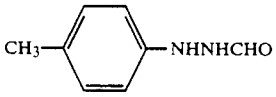

I-3

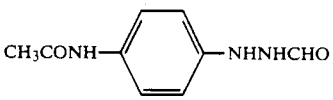

I-4

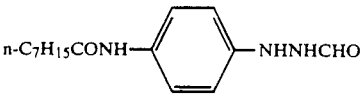

I-5

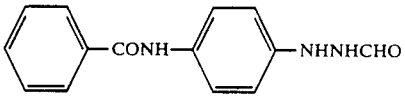

I-6

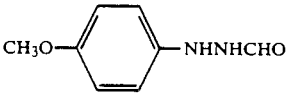

I-7

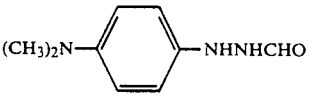

I-8

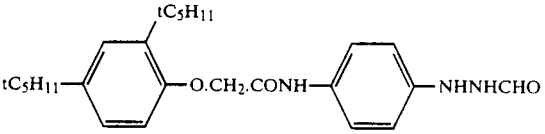

I-9

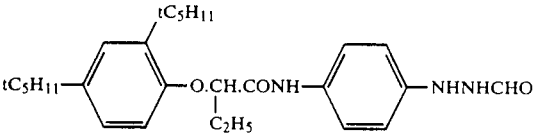

I-10

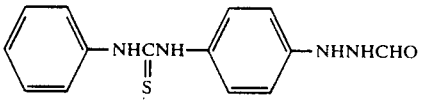

I-11

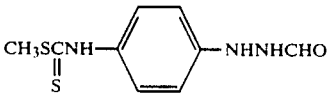

-continued
I-12
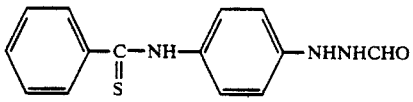
I-13
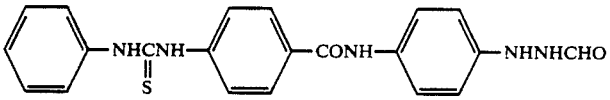
I-14
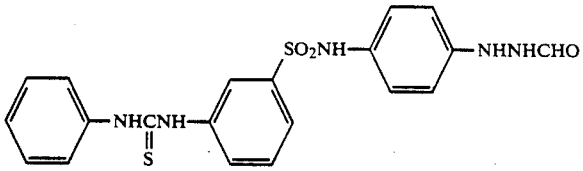
I-15
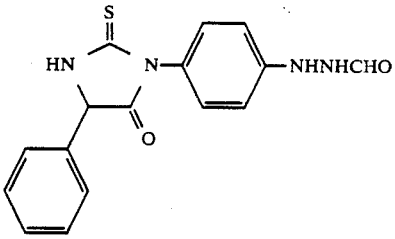
I-16
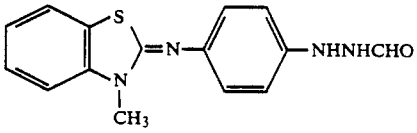
I-17
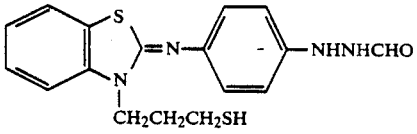
I-18
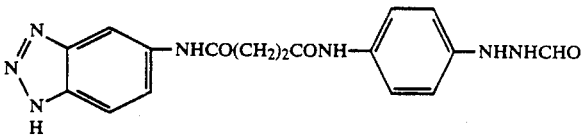
I-19
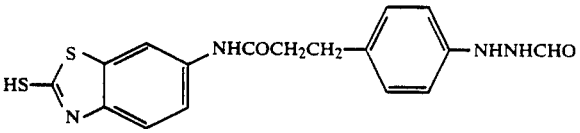
I-20
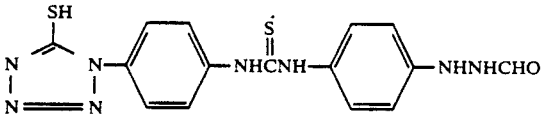
I-21
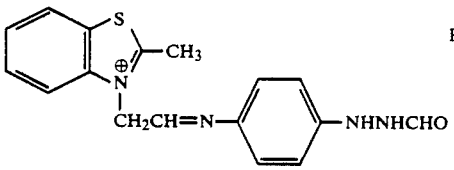

-continued
I-22
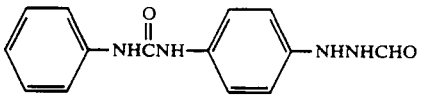
I-23
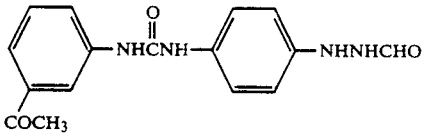
I-24
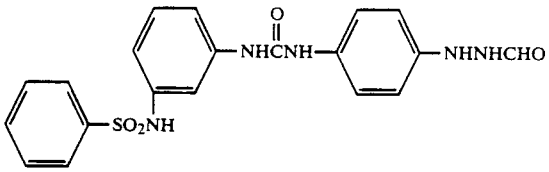
I-25
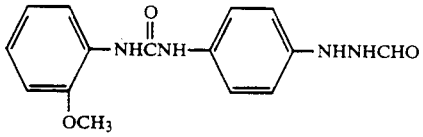
I-26
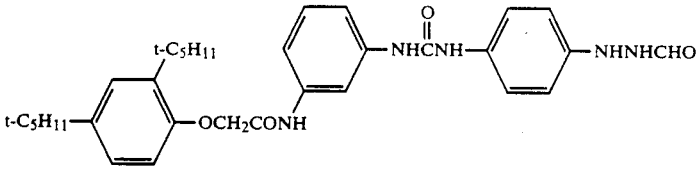
I-27
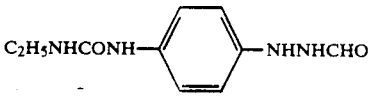
I-28
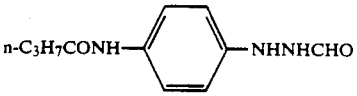
I-29
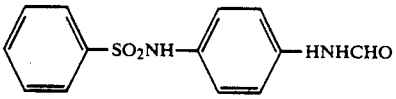
I-30
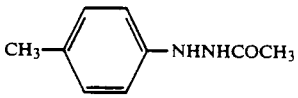
I-31
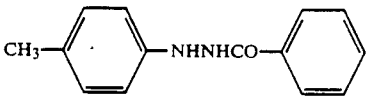
I-32
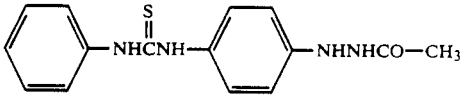
I-33
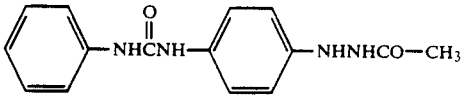

-continued
I-34
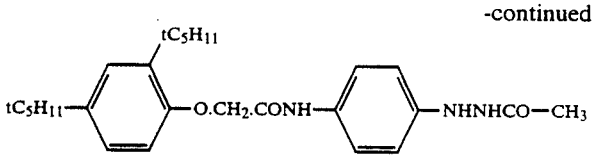
I-35
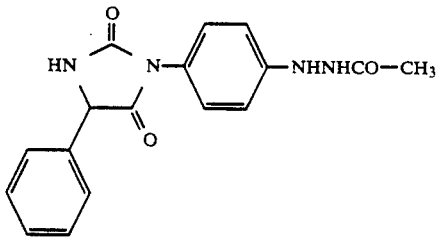
I-36
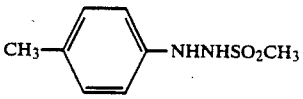
I-37
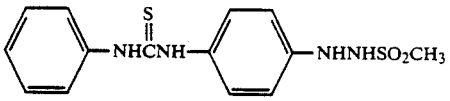
I-38
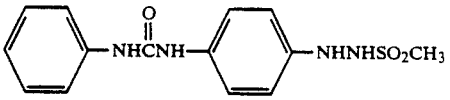
I-39
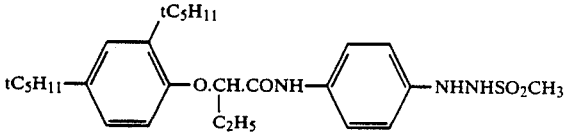
I-40
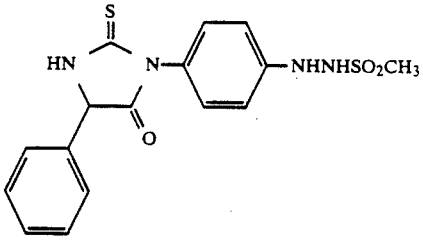
I-41
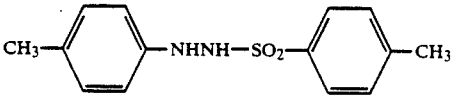
I-42
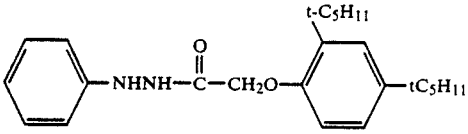
I-43
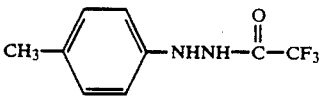
I-44
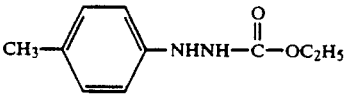

-continued
I-45
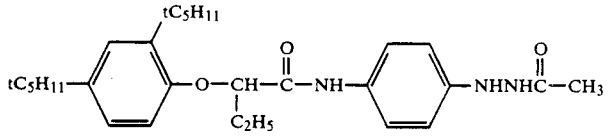
I-46
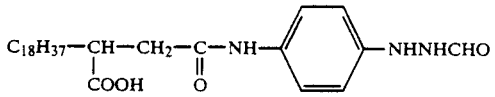
I-47
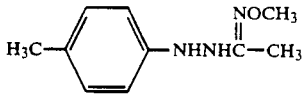
I-48
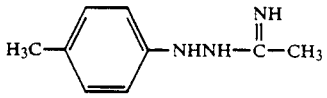
I-49
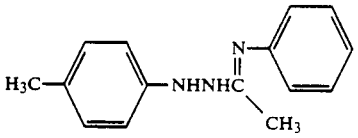
I-50
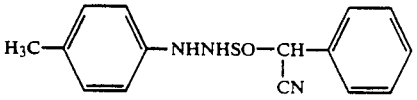
I-51
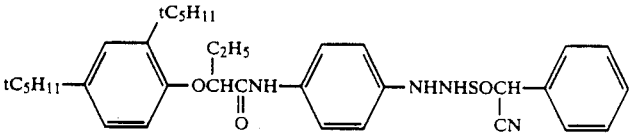
I-52
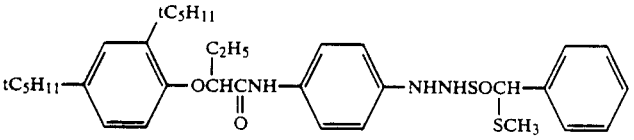
I-53
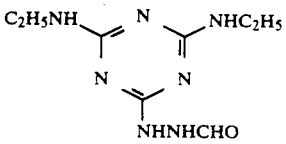
I-54
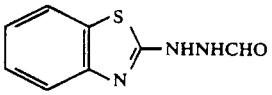
I-55
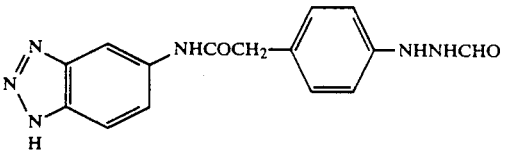

-continued

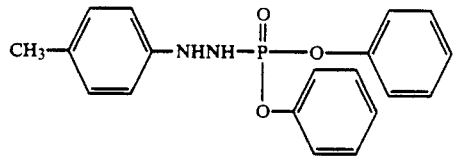

I-56

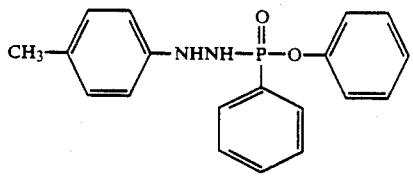

I-57

These compounds can be prepared by methods as described in Japanese Patent Application (OPI) Nos. 20921/78, 20922/78, 66732/78, and 20318/78.

When the compound of the general formula (I) is incorporated in a photographic light-sensitive material, it may be added to any desired one or more hydrophilic colloid layers of the light-sensitive material. Although it is preferred for the compound of the general formula (I) to be incorporated into a silver halide photographic emulsion layer, it may be added to other light-insensitive layers such as a protective layer, an interlayer, a filter layer, and an anti-halation layer. The compound of the general formula (I) is dissolved in organic solvent compatible with water, such as alcohols (e.g., methanol and ethanol), esters (e.g., ethyl acetate) and ketones (e.g., acetone), or, when soluble in water, dissolved in water, and then added to a hydrophilic colloid solution in the form of an organic solvent solution or aqueous solution.

When the compound of the general formula (I) is added to a photographic emulsion layer, it may be added at any desired point from the start of chemical ripening to the coating of the emulsion. Preferably it is added after the chemical ripening is completed. It is particularly preferred that the compound be added to a coating solution prepared for coating.

The compound of the general formula (I) is preferably added in an amount of from $1\times10^{-6}$ to $5\times10^{-2}$ mol per mol of silver halide and more preferably in an amount of from $1\times10^{-5}$ to $2\times10^{-2}$ mol per mol of silver halide. It is desirable that the amount of the compound of the general formula (I) being added be determined appropriately depending on the grain diameter of a silver halide emulsión, halogen composition, method and degree of chemical sensitization, relation between a layer containing the compound and a photographic emulsion layer, type of an anti-foggant, and so , forth. This can be easily done by one skilled in the art.

The light-insensitive top layer of the present invention is a layer substantially made of hydrophilic colloid which is provided on the entire surface of the light-sensitive silver halide emulsion layer. The light-insensitive top layer may be of a single layer structure. In some cases, two or more light-insensitive top layers may be provided.

In the present invention, the melting time of at least one of the light-insensitive top layers is greater than that of the emulsion layer. This means that the light-insensitive layer is hardened more strongly than the emulsion layer. It is most suitable that the melting time be determined in a 0.2N NaOH solution maintained at 75° C., although the present invention is not limited thereto.

In order to make the melting time of at least one of the light-insensitive top layers greater than that of the light-sensitive silver halide emulsion layer, it suffices that a degree of hardening of the light-insensitive top layer is selectively made greater than that of the light-sensitive silver halide emulsion layer. In this case, hardening is performed selectively so that the melting time of at least one of the light-insensitive top layers, as determined by the above-described measuring method, is at least 50 seconds, preferably at least 100 seconds longer than that of the sensitive layer.

Selective hardening of at least one light-insensitive top layer can be conducted by various procedures. One is a method as described in Japanese Patent Publication No. 17112/67 in which gelatin to be used as a main binder for the light-insensitive top layer and a diffusible low molecular hardening agent are reacted before coating to an extent that does not deteriorate coating characteristics and, thereafter, coated. Polymers having a functional group capable of cross-linking with gelation through a hardening agent, as described in U.S. Pat. No. 4,207,109 can also be used.

In addition, polymers having a functional group capable of reacting with gelatin (polymeric hardening agents) as described in Japanese Patent Application (OPI) No. 66841/81, British Patent 1,322,971, U.S. Pat. No. 3,671,251, D.M. Burness & J. Pouradier, *The Theory of the Photographic Process*, 4th ed., (T. H. James ed.), Macmillan New York (1977), page 84, G. A. Cambell, L. R. Hamilton & I. S. Ponticello, *Polymeric Amine and Ammonium Salts*, (E. J. Goethals ed.), Pergamon Press, New York (1979), pages 321–332, and so forth can be used.

Polymeric hardening agents are especially preferred to attain the objects of the present invention.

Polymeric hardening agents represented by the after are preferred. Particularly preferred are the polymeric hardening agents of the general formula (II).

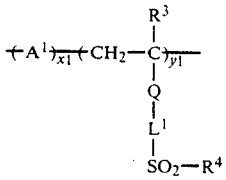

(II)

wherein:

$A^1$ is an ethylenically unsaturated monomer capable copolymerizing with a monomer unit present adjacent thereto at the right side thereof;

$R^3$ is a hydrogen atom, or a lower alkyl group having from 1 to 6 carbon atoms;;

Q is $$-CO_2-,\ -CO-\overset{R^3}{\overset{|}{N}}-$$

(wherein $R^3$ is the same as defined above), or an arylene group having from 6 to 10 carbon atoms;

$L^1$ is a divalent group containing at least one of $$-CO_2- \text{ and } -\overset{R^3}{\overset{|}{CON}}-$$

(wherein $R^3$ is the same as defined above) and having from 3 to 15 carbon atoms, or a divalent group containing at least one of $$-O-,\ -\overset{R^3}{\overset{|}{N}}-,\ -CO-,\ -SO-,\ -SO_2-,\ -SO_3-,$$

$$-SO_2\overset{R^3}{\overset{|}{N}}-,\ -\overset{R^3}{\overset{|}{N}}-\overset{R^3}{\overset{|}{CON}}-,\ \text{and}\ -\overset{R^3}{\overset{|}{N}}-CO_2$$

(wherein $R^3$ is the same as defined above) and having from 1 to 12 carbon atoms;

$R^4$ is a vinyl group or its precursor; i.e., is either $-CH{=}CH_2$ or $-CH_2CH_2X^1$ (wherein $X^1$ is a group replaceable with a nucleophilic group, or a group capable of being released in the form of $HX^1$ by the action of bases); and $x_1$ and $y_1$ represent mol percents; $x_1$ is from 0 to 99 and $y_1$ is from 1 to 100.

The ethylenically unsaturated monomer of $A^1$ in the general formula (II) include ethylene, propylene, 1-butene, isobutene, styrene, chloromethylstyrene, hydroxymethylstyrene, sodium vinylbenzenesulfonate, sodium vinylbenzylsulfonate, N,N,N-trimethyl-N-vinylbenzylammonium chloride, N,N-dimethyl-N-benzyl-N-vinylbenzylammonium chloride, α-methylstyrene, vinyltoluene, 4-vinylpyridine, 2-vinylpyridine, benzylvinylpyridium chloride, N-vinylacetamide, N-vinylpyrrolidone, 1-vinyl-2-methylimidazole, fatty acid monotethylenically unsaturated esters (e.g., vinyl acetate and acryl acetate), ethylenically unsaturated monocarboxylic acids or dicarboxylic acids, or their salts (e.g., acrylic acid, methacrylic acid, itaconic acid, maleic acid, sodium acrylate, potassium acrylate, and sodium methacrylate), maleic anhydride, ethylenically unsaturated monocarboxylic or dicarboxylic acid esters (e.g., n-butyl acrylate, n-hexyl acrylate, hydroxyethyl acrylate, cyanoethyl acrylate, N,N-diethylaminoethyl acrylate, methyl methacrylate, n-butyl methacrylate, benzyl methacrylate, hydroxyethyl methacrylate, chloroethyl methacrylate, methoxyethyl methacrylate, N,N-diethylaminoethyl methacrylate, N,N,N-triethyl-N-methacryloyloxyethylammonium p-toluenesulfonate, N-diethyl-N-methyl-N-methacryloyloxyethylammonium p-toluenesulfonate, dimethyl itaconate, and monobenzyl maleate), and ethylenically unsaturated mono- or di-carboxylic acid amides (e.g., acrylamide, N,N-dimethylacrylamide, N-methylolacrylamide, N-(N,N-dimethylaminopropyl)acrylamide, N,N,N-trimethyl-N-(N-acryloylpropyl) ammonium p-toluenesulfonate, sodium 2-acrylamido-2-methylpropanesulfonate, acryloylmorpholine, methacrylamide, N,N-dimethyl-N'-acryloylpropaneamine propionate betaine, and N,N-dimethyl-N'-methacryloylpropanediamine acetate betaine).

When the polymeric hardening agents of the general formula (II) are used as cross-linked latexes, $A^1$ includes, as well as the above-described ethylenically unsaturated monomers, monomers containing at least two ethylenically unsaturated groups (e.g., divinylbenzene, methylenebisacrylamide, ethylene glycol diacrylate, trimethylene glycol diacrylate, ethylene glycol dimethacrylate, trimethylene glycol dimethacrylate, and neopentyl glycol dimethacrylate).

Examples of $R^3$ in the general formula (II) include a methyl group, an ethyl group, a butyl group, and a n-hexyl group.

Q includes the following groups:

$$-CO_2-,\ -CONH-,\ -\overset{CH_3}{\overset{|}{CON}}-,$$

$$-\overset{C_2H_5}{\overset{|}{CON}}-,\ -\overset{nC_4H_9}{\overset{|}{CON}}-,$$

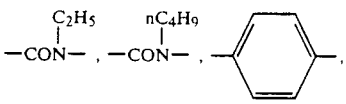

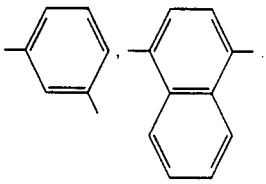

$L^1$ includes the following groups:

$-CH_2C02CH_2-$ $-CH_2C02CH_2CH_2-$ $-CH_2CH_2C02CH_2CH_2-$ $-(CH_2)_5CO_2CH_2CH_2-$ $-(CH_2)_{10}CO_2CH_2CH_2-$ $-CH_2NHCOCH_2-$ $-CH_2NHCOCH_2CH_2-$ $-(CH_2)_3NHCOCH_2CH_2-$ $-(CH_2)_5NHCOCH_2CH_2CH_2-$ $-(CH_2)_{10}NHCOCH_2CH_2-$ $-CH_2CH_2-$ $-CH_2CH_2OCH_2CH_2CH_2-$ $$-\overset{CH_3}{\overset{|}{N}}CH_2CH_2-,\ -CH_2\overset{CH_3}{\overset{|}{N}}CH_2CH_2-$$

$-COCH_2CH_2-$ $-CH_2COCH_2CH_2-$

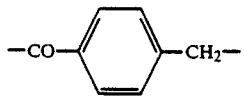

$-SOCH_2CH_2-$ $-CH_2SOCH_2CH_2-$ $-SO_2CH_2CH_2-$ $-SO_2CH_2CH_2SO_2CH_2CH_2-$ $-SO_2CH_2CH_2SO_2CH_2\underset{\underset{OH}{|}}{C}HCH_2-$ $-SO_3CH_2CH_2CH_2-$ $-SO_3CH_2CO_2CH_2CH_2-$ $-SO_3CH_2CH_2CO_2CH_2CH_2-$ $-SO_2NHCH_2CO_2\ CH_2CH_2-$ $-SO_2NHCH_2CH_2CO_2CH_2CH_2-$ $-NHCONHCH_2CH_2-$ $-CH_2NHCONHCH_2CH_2-$ $-NHCO_2CH_2CH_2-$ $-CH_2NHCO_2CH_2CH_2-$ $R^4$ of the general formula (II) includes the following groups:

$-CH{=}CH_2$, $-CH_2CH_2Cl$, $-CH_2CH_2Br$, $-CH_2CH_2O_3SCH_3$, $-CH_2CH_2O_3S-$

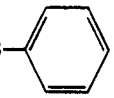

$-CH_2CH_2O_3S-$

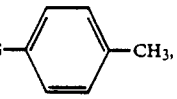

$-CH_3$, $-CH_2CH_2OH$, $-CH_2CH_2O_2CCH_3$, $-CH_2CH_2O_2CCF_3$, $-CH_2CH_2O_2CCHCl_2$,

Other preferred polymeric hardening agents are described in U.S. Pat. No. 4,161,407 and have a repeating unit represented by the general formula (III), $$\left(A^2\right)_{x_2}\left(CH_2\underset{\underset{CH^2-\overset{\overset{O}{\|}}{\underset{\underset{O}{\|}}{S}}-R^6}{|}}{\overset{\overset{R^5}{|}}{\overset{\overset{L^2}{|}}{C}}}\right)_{y_2} \quad \text{(III)}$$

wherein:

$A^2$ is an ethylenically unsaturated monomer unit or monomer mixture capable of copolymerizing with a monomer unit present adjacent thereto at the right side thereof;

$x_2$ and $y_2$ represent mol percents; $X_2$ is from 10 to 95 and $y_2$ is from 5 to 90;

$R^5$ is a hydrogen atom, or an alkyl group having from 1 to 6 carbon atoms;

$R^6$ is $-CH{=}CH_2$ or $-CH_2CH_2X^2$ (wherein $X^2$ is a group capable of being replaced by a nucleophilic group, or a group capable of being released in the form of $HX^2$ by the action of bases); and $L^2$ is a connecting group selected from the group consisting of alkylene (more preferably alkylene having from 1 to 6 carbon atoms, such as methylene, ethylene, and isobutylene), arylene having from 6 to 12 carbon atoms (e.g., phenylene, tolylene, and naphthalene), $-COZ^1-$, and $-COZ^1R^7-$ (wherein $R^7$ is alkylene having from 1 to 6 carbon atoms, or arylene having from 6 to 12 carbon atoms, and $Z^1$ is an oxygen atom or $-NH-$).

$A^2$ of the general formula (III) includes the examples listed as $A^1$ of the general formula (II). $R^5$ of the general formula (III) includes the examples listed as $R^3$ of the formula (II). $R^6$ of the general formula (III) includes the examples listed as $R^4$ of the general formula (II).

Other preferred polymeric hardening agents are described in British Patent 1,534,455 and have the repeating unit represented by the general formula (IV):

$$\left(A^3\right)_{x_3}\left(CH_2-\underset{\underset{X^3}{|}}{\overset{\overset{R^8}{|}}{\underset{\underset{(L^3)_m}{|}}{C}}}\right)_{y_3} \quad \text{(IV)}$$

wherein:

A3 is an ethylenically unsaturated monomer unit capable of copolymerizing with a monomer unit present adjacent thereto at the right side thereof;

$R^8$ is a hydrogen atom, or an alkyl group having from 1 to 6 carbon atoms;

$L^3$ is a divalent connecting group having from 1 to 20 carbon atoms (more preferably a divalent group having from 1 to 12 and containing at least one of —CONH— and —CO—);

$X^3$ is an active ester group;

$x_3$ and $y_3$ represent mol percents; $x_3$ is from 0 to 95 and $y_3$ is 5 or 100; and m is 0 or 1.

$A^3$ of the general formula (IV) includes the examples listed for $A^1$ of the general formula (II).

$R^8$ of the general formula (IV) includes the examples listed for $R^3$ of the general formula (II).

$L^3$ of the general formula (IV) includes the following groups: $-CONHCH_2-$, $-CONHCH_2CH_2-$, $-CONHCH_2CH_2CH_2-$, $-CONHCH_2CH_2CH_2CH_2CH_2-$, $-COCH_2CH_2OCOCH_2CH_2-$, $-CONHCH_2CONHCH_2-$, $-CONHCH_2CONHCH_2CONHCH_2-$, $-COCH_2-$, $-CONHCH_2NHCOCH_2CH_2SCH_2CH_2-$, $-CONHCH_2OCOCH_2CH_2-$ $X^3$ of the general formula (IV) includes the following groups:

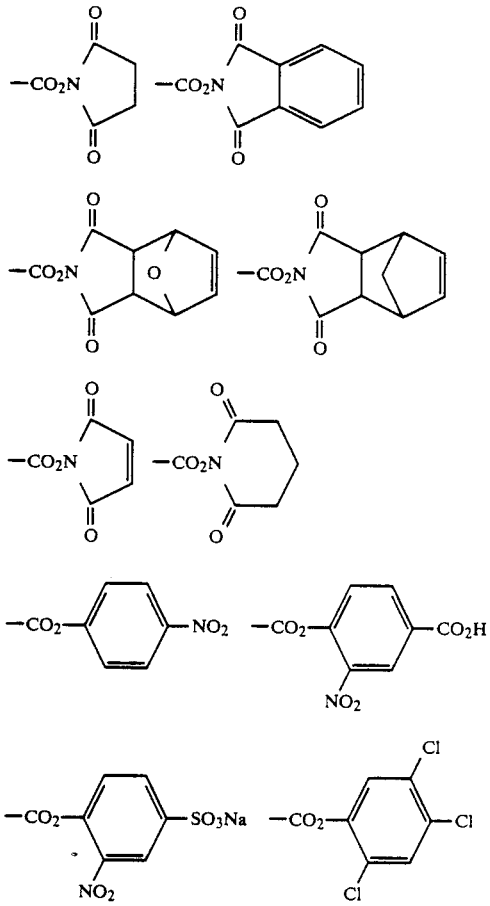
-continued
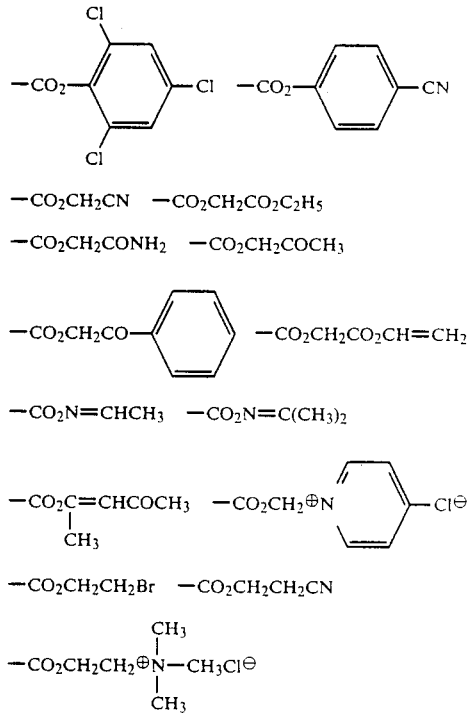
Representative examples of compounds which can be used as hardening agents in the present invention are shown below, although the present invention is not limited thereto.
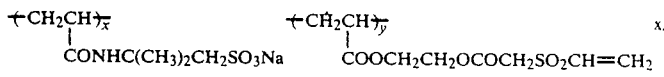
x/y = 3/1 P-1
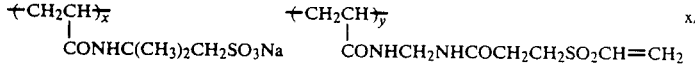
x/y = 3/1 P-2
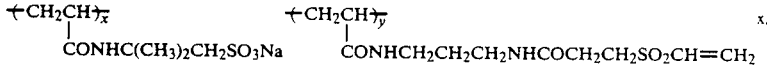
x/y = 3/1 P-3
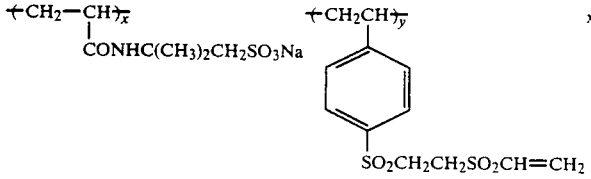
x/y = 3/1 P-4
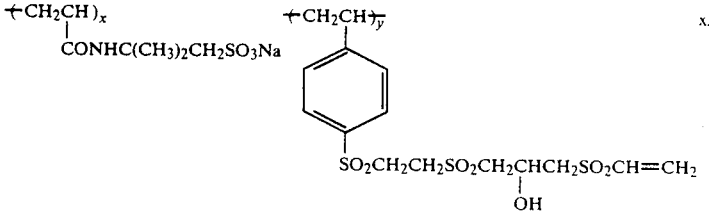
x/y = 3/1 P-5
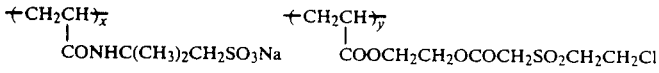
x/y = 3/1 P-6

-continued
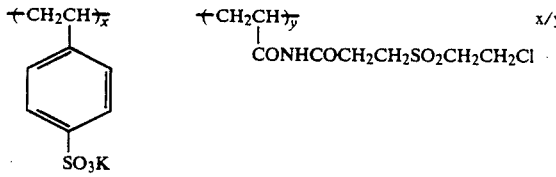
P-7
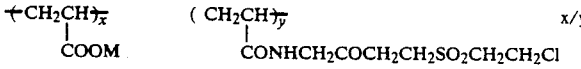
P-8
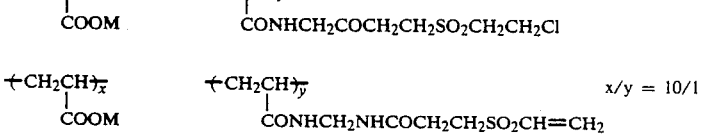
P-9
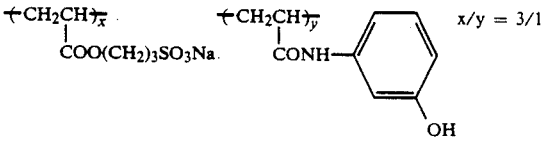
P-10
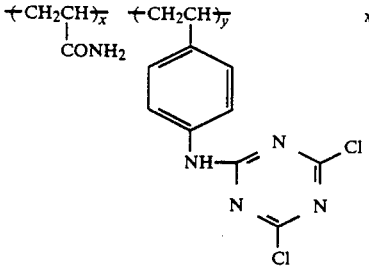
P-11
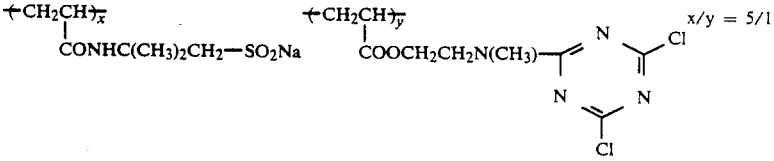
P-12
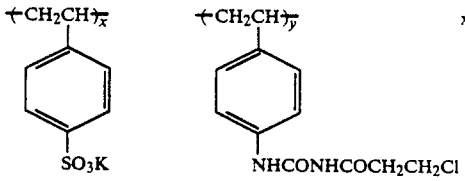
P-13
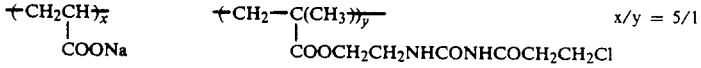
P-14
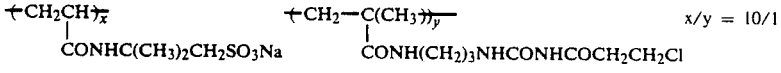
P-15
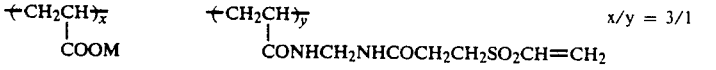
P-16
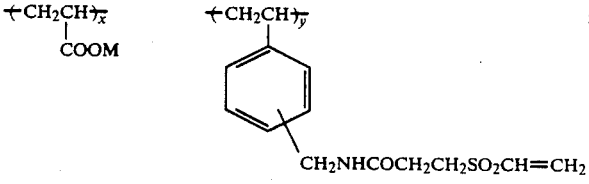
P-17

-continued

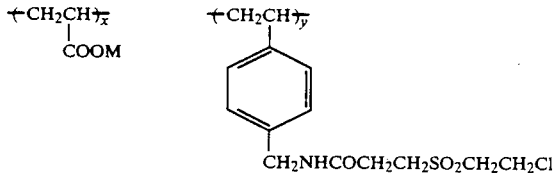

x/y = 3/1 P-18

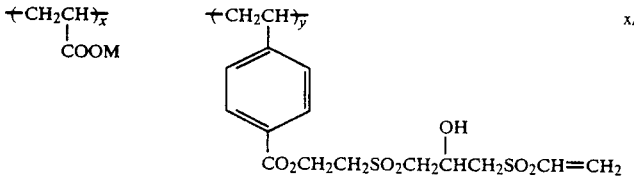

x/y = 3/1 P-19

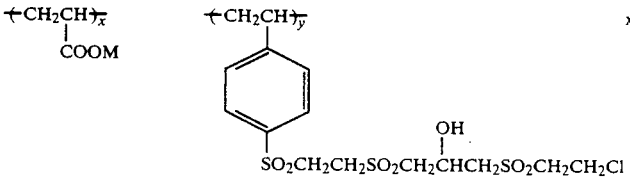

x/y = 3/1 P-20

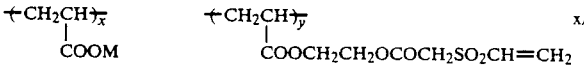

x/y = 3/1 P-21

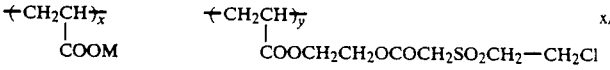

x/y = 3/1 P-22

In the above formulae, M is a hydrogen atom, a sodium atom, or a potassium atom, and x and y each represent a mol percentage of each unit to be supplied; x and y are not limited to the above-defined values of $x_1$, $y_1$, $x_2$, $y_2$, $x_3$, or $y_3$ but can vary within the ranges of from 0 to 99 and from 1 to 100, respectively.

Polymeric hardening agents as used herein can be prepared by methods as described in Japanese Patent Application (OPI) No. 42039/83, for example.

In hardening the light-insensitive top layer, the above-described polymeric hardening agents may be used singly, or may be used in combination with diffusible low molecular weight hardening agents. In the latter case, the diffusible low molecular weight hardening agent diffuses even in the emulsion layer and hardens it. Since, on the other hand, the light-insensitive top layer is hardened by both the low molecular hardening agent and the diffusion-resistant polymeric hardening agent, it can be hardened selectively. These diffusible low molecular hardening agents include various types of organic or inorganic hardening agents, which are used singly or in combination with each other. Typical examples are aldehydes such as mucochloric acid, formaldehyde, trimethylolmelamine, glyoxal, 2,3-dihydroxy-1,4-dioxane, 2,3-dihydroxy-5-methyl-1,4-dioxane, succinaldehyde, and glutaraldehyde; active vinyl compounds such as divinyl sulfone, methylenebismaleimide, 1,3,5-triacryloyl-hexahydro-s-triazine, 1,3,5-trivinylsulfonyl-hexahydro-s-triazine, bis(vinylsulfonylmethyl) ether, 1,3-bis(vinylsulfonyl)propanol-2, bis(α-vinylsulfonylacetamido)-ethane, 1,2-bis(vinylsulfinyl)-ethane, and 1,1'-bis(vinylsulfinyl)methane; active halogeno compounds such as 2,4-dichloro-6-hydroxy-s-triazine; and ethyleneimine-based compounds such as 2,4,6-triethyleneimino-s-triazine. They are well known in the art as gelatin hardeners. Preferably they are used in combination with active vinyl-based low molecular weight hardening agents.

The polymeric hardening agent is dissolved in water or an organic solvent and then added directly to a layer which is intended to control the degree of hardening. When a diffusible hardening agent is used in combination, it may be added to the light-insensitive top layer to which the polymeric hardening agent has been added, or alternatively it may be added to other light-insensitive top layers and allowed to diffuse in all layers. The amount of the diffusion-resistant polymeric hardening agent being added is determined based on the amount of the reactive group in the polymeric hardening agent.

As a hydrophilic colloid binder to be used in the light-insensitive top layer, it is advantageous to use gelatin. In addition, moldified gelatins and synthetic polymers such as polyvinyl alcohol and polyvinyl pyrrolidone can be used. As the gelatin, any of lime-treated gelatin, acid-treated gelatin, and the like can be used. Of these compounds, acid-treated gelatin is preferred in that it causes less reticulation and exerts good influences on the reduction performance.

The amount of the hydrophilic colloid binder used in preparation of the light-insensitive top layer of the present invention is not critical. If it is equal to or more than that in the light-sensitive silver halide emulsion layer, the effects of the present invention become more marked.

In the light-insensitive top layer of the present invention, as well as the above-described hydrophilic colloid binder, surface active agents, anti-static agents, matting agents, lubricants, colloidal silica, gelatin plasticizers, polymer latexes, and the like can be used.

At least one light-sensitive silver halide emulsion layer is sandwiched between the above-described light-insensitive top layer and the support.

Silver halide which can be used in the silver halide emulsion layer includes silver chloride, silver chlorobromide, silver iodobromide, and silver iodobromochloride. It is preferably composed of at least 40 mol % of silver chloride, and more preferably composed of at least 70 mol % silver chloride.

It is preferred that the silver iodide content be not more than 5 mol %, with the content of not more than 1 mol % being more preferred.

Silver halide grains in the photographic emulsion of the present invention can have a relatively broad grain size distribution but it is preferred for them to have a narrow grain size distribution. It is particularly preferred that 90% in both weight and number of silver halide grains have grain sizes falling within the range of average grain size ±40%. Such an emulsion is generally called a single dispersion emulsion.

Silver halide grains are preferably finely divided (for example, an average grain size of not more than 0.7μ). Particularly preferred is an emulsion having an average grain size of from 0.1 to 0.4μ.

In the silver halide emulsion of the present invention, in the course of formation or physical ripening of silver halide grains, metallic salts such as cadmium salts, zinc salts, lead salts, thallium salts, iridium salts or its complex salts, rhodium salts or its complex salts, and iron salts or its complex salts may be allowed to coexist.

Of the above metallic salts, rhodium salts (including complex salts) can most increase the effects of the present invention. That is, if a silver halide emulsion prepared by carrying out the formation of grains or physical ripening in the presence of rhodium salts is employed, there can be obtained the effects that high sensitivity and super contrast can be obtained from the beginning of development and, furthermore, the formation of fog when the developing time is lengthened or the developing temperature is raised can be reduced.

Addition of such rhodium salts or its complex salts must be conducted prior to the end of the first ripening in the course of production of the emulsion. It is particularly preferred that they be added during the formation of grains. The amount of the salt or complex salt added is preferably from $1\times10^{-8}$ to $1\times10^{-5}$ mole per mol of silver, with the range of from $1\times10^{-7}$ to $1\times10^{-6}$ mol per mol of silver being more preferred. Typical examples of rhodium salts or its complex salts which can be used are rhodium chloride, rhodium trichloride, and rhodium ammonium chloride.

It is preferred for the formation of grains to be carried out in the acidic condition. The pH range is preferably not more than 6 and more preferably not more than 5.

Soluble silver salts and soluble halogen salts can be reacted by any of a single-jet method, a double-jet method, and a combination thereof.

In addition, a method (a so-called reversal mixing method) can be used in which grains are formed in the presence of an excess of silver ions. A so-called controlled double-jet method, which is one of the double-jet methods and in which pAg in a liquid layer where silver halide is formed is maintained at a constant value, can also be employed. In accordance with this method, there can be obtained a silver halide emulsion in which the crystal form is regular and the grain size is nearly uniform.

Silver halide grains in the photographic emulsion may have a regular crystal form such as a cubic form and an octahedral form, or an irregular crystal form such as a thereof. They may be composed of grains having different crystal forms.

Gelatin is advantageously used as a binder or protective colloid for the photographic emulsion. In addition, other hydrophilic colloids can be used. For example, proteins such as gelatin derivatives, graft polymers of gelatin and other polymers, albumin, and casein; sugar derivatives such as cellulose derivatives (e.g., hydroxyethyl cellulose, carboxymethyl cellulose, and cellulose sulfate), sodium alginate, and starch derivatives; and a wide variety of synthetic hydrophilic polymers, homopolymers or copolymers, such as polyvinyl alcohol, polyvinyl alcohol partial acetal, poly(N-vinyl) pyrrolidone, polyacrylic acid, polymethacrylic acid, polyacrylamide, polyvinyl imidazole, and polyvinyl pyrazole can be used.

With regard to the weight ratio of silver halide to hydrophilic colloidal binder in the silver halide emulsion layer of the present invention, it is preferred that the weight ratio of hydrophilic colloid binder to silver halide be 1:2 or less.

In the present invention, the silver halide emulsion layer may be a single layer, or two or more silver halide emulsion layers may be provided.

For example, when two silver halide emulsion layers are provided, it is more preferred that the ratio of silver halide to hydrophilic colloid polymer in the two layers be 1:2 or less and, furthermore, the hydrophilic colloid binder content of the upper light-sensitive emulsion layer be greater than that of the lower light-sensitive emulsion layer.

The amount of silver halide coated is, calculated as silver, from 1.0 to 6.0 g, preferably from 1.5 to 4.0 g per square meter.

The effect of the present invention that the reduction width is increased becomes particularly marked when the amount of silver coated is small.

The silver halide emulsion to be used in the present invention may not be chemically sensitized, but it is preferably chemically sensitized. Chemical sensitization of the silver halide emulsion can be performed by techniques such as sulfur sensitization, reduction sensitization, and noble metal sensitization. They can be applied singly or in combination with each other. Details of this chemical sensitization are described in, for example, P. Glafkides, *Chimie et Physique Photographique*, Paul Montel (1967), V. L. Zelikman et al., *Making and Coating Photographic Emulsion*, The Focal press (1964) and *Die Gründlagen der Photographischen Prozesse mit Silberhalogeniden*, edited by H. Frieser, Akademische Verlagsgesellschaft (1968).

A typical example of the noble metal sensitization method is a gold sensitization method in which gold compounds, mainly gold complex salts are used. Complex salts of noble metals other than gold, such as platinum, palladium, and iridium may be incorporated. Representative examples are 1 described in U.S. Pat. No. 2,448,060 and British Patent 618,061.

As sulfur sensitizers, as well as sulfur compounds contained in gelatin, various sulfur compounds such as thiosulfuric acid salts, thioureas, thiazoles, and rhodanines can be used. Representative examples are described in U.S. Pat. Nos. 1,574,944, 2,278,947, 2,410,689, 2,728,668, 3,501,313, and 3,656,955.

As reduction sensitizers, stannous salts, amines, formamidinesulfini acid, silane compounds, and the like can be used. Representative examples are described in U.S. Pat. Nos. 2,487,850, 2,518,698, 2,983,609, 2,983,610, and 2,694,637.

Various compounds can be incorporated in the light-sensitive material of the present invention for the purpose of preventing fog during the process of production, storage or photographic processing of the light-sensitive material, or of stabilizing its photographic performance. That is, many compounds known as anti-foggants or stabilizers, such as azoles (e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles, particularly 1-phenyl-5-mercaptotetrazole), mercaptopyrimidines; mercaptotriazines; thioketo compounds (e.g., oxazolinethione); azaindenes (e.g., triazaindenes, tetraazaindenes, particularly 4-hydroxy-substituted- (3,3a,7)tetratraazaindenes, pentaazaindenes, and the like); benzenethiosulfonic acid, benzenesulfinic acid, benzenesulfonic acid amide, and the like can be added. Particularly preferred of these compounds are benzotriazoles (e.g., 5-methyl-benzotriazole) and nitroindazoles (e.g., 5-nitroindazole). These compounds may be incorporated in a processing solution.

In the light-sensitive material of the present invention can be various compounds as described in Japanese Patent Application No. 125602/78, pages 45–53, including:

sensitizing dyes, such as cyanine dyes and merocyanine dyes, which may be used singly or in combination with each other;

super sensitizers such as aminostylbene compounds, aromatic organic acid/formaldehyde condensates, cadmium salts, and azaindene compounds;

water-soluble dyes such as oxanol dyes, hemioxanol dyes, and merocyanine dyes, which are used as filters or for the purpose of preventing irradiation;

hardening agents such as chromium salts, aldehydes, N-methylol compounds, dioxane derivatives, active vinyl compounds, and active halogen compounds; and surface active agents such as known various nonionic, anionic, cationic and amphoteric surface active agents, with the polyoxyalkylenes described in Japanese Patent Application (OPI) No. 37732/79 being particularly useful.

Polyalkylene oxide or its derivatives which are preferably used in the present invention have a molecular weight of at least 600. These compounds may be incorporated in the silver halide light-sensitive material, or in the developer.

These polyalkylene oxide compounds include condensates of polyalkylene oxides comprising at least 10 $C_2$–$C_4$ alkylene oxides such as ethylene oxide, propylene-1,2-oxide, and butylene-1,2-oxide (preferably ethylene oxide) and compounds containing at least one active hydrogen atom, such as water, aliphatic alcohols, aromatic alcohols, fatty acids, organic amines, and hexytol derivatives, and block copolymers of at least two polyalkylene oxides.

Representative examples of polyalkylene oxide compounds that can be used include polyalkylene glycols, polyalkylene glycol alkyl ethers, polyalkylene glycol aryl ethers, polyalkylene glycol alkylaryl ethers, polyalkylene glycol esters, polyalkylene glycol fatty acid amides, polyalkylene glycol amines, polyalkylene glycol block copolymers, and polyalkylene glycol graft polymers.

The number of polyalkylene oxide chains contained in the molecule is not limited to one; two or more polyalkylene oxide chains may be contained in the molecule. In this case, each polyalkylene oxide chain may be composed of less than 10 alkylene oxide units, but the total number of alkylene oxide units in the molecule must be at least 10. When two or more polyalkylene oxide chains are contained in the molecule, they may be composed of different alkylene oxide units; for example, one is composed of ethylene oxide and the other, of propylene oxide. The polyalkylene oxide compound preferably contains from 14 to 100 alkylene oxide units.

The light-sensitive material of the present invention can contain dispersions of water-insoluble or sparingly water-soluble synthetic polymers for the purpose of, e.g., improving dimensional stability. For example, homo- or co-polymers of alkyl acrylate or methacrylate, alkoxyalkyl acrylate or methacrylate, glycidyl acrylate or methacrylate, acrylamide or methacrylamide, vinyl esters (e.g., vinyl acetate), acrylonitrile, olefins, styrene, and the like, and copolymers of the above compounds and such compounds as acrylic acid, methacrylic acid, $\alpha,\beta$-unsaturated dicarboxylic acid, hydroxyalkyl acrylate or methacrylate, sulfoalkyl acrylate or methacrylate, and styrenesulfonic acid can be used for this purpose. For example, compounds as described in U.S. Pat. Nos. 2,376,005, 2,739,137, 2,853,457, 3,062,674, 3,411,911, 3,488,708, 3,525,620, 3,607,290, 3,635,715, 3,645,740, and British Patents 1,186,699 and 1,307,373. High contrast emulsions of the present invention are suitable for reproduction of line images. Since dimensional stability is important in such an application, it is preferred for the light-sensitive material to contain polymer dispersions as described above.

The silver halide photographic light-sensitive material of the present invention does not need conventional infectious developers (lith developers) and a high alkaline developer having a pH near 13 as described in U.S. Pat. No. 2,419,975 permits the formation of super contrast negative images using astable developer.

For the light-sensitive material of the present invention, a developer containing a sufficient amount (especially not less than 0.15 mol/l) of sulfite ion as a preservative can be used. Even with a developer having a pH of at least 9.5, especially from 10.5 to 12.3, super contrast that is sufficiently satisfactory can be obtained.

The light-sensitive material of the present invention is greatly advantageous to use in that photographic characteristics of super contrast (gamma in excess of 10), high sensitivity, and negative gradation can be obtained in a relatively short period of time using a stabilized developer as described above.

The light-sensitive material of the present invention is not limited in developing agents to be used in development thereof. For example, 3-pyrazolidones (e.g., 1-phenyl-3-pyrazolidone and 4,4-dimethyl-1-phenyl-3-pyrazolidone), aminophenols (e.g., N-methyl-p-aminophenol), 1-phenyl-3-pyrazolines, and dihydroxybenzenes (e.g., hydroquinone) can be used singly or in combination with each other.

The light-sensitive material of the present invention is suitable to develop particularly with a developer containing dihydroxybenzenes as the developing agent and 3-pyrazolidones as the auxiliary developing agent. In this developer, it is preferred that the concentrations of dihydroxybenzenes and 3-pyrazolidones be controlled within the ranges of from 0.05 to 0.5 mol/l and not more than 0.06 mol/l, respectively.

In general, the developer further contains known additives such as a preservative, an alkali agent, a pH buffer, and an antifoggant (especially preferably nitroindazoles and benzotriazoles). If necessary, it may further contain a dissolving acid, a color controller, a development accelerator, a surface active agent (especially preferably polyalkylene glycols as described above), a defoaming agent, a hard water-softening agent, a hardening agent, a tackifier, an agent to prevent transfer contamination of films with silver, and the like.

Fixers having compositions commonly used can be used. As fixing agents, as well as thiosulfates and thiocyanates, organosulfurous compounds known to be effective as a fixing agent can be used. The fixer may contain water-soluble aluminum salts, for example, as the hardening agent.

The light-sensitive material of the present invention is usually processed within a temperature range of from 18° to 50° C.

In processing of the light-sensitive material of the present invention, it is preferred to use an automatic developing machine. In accordance with a preferred embodiment of the present invention, even if the total processing time from the introduction of the light-sensitive material into the automatic developing machine to the withdrawal thereof after completion of processing is set at 90–120 seconds, photographic characteristics of super contrast that is sufficiently satisfactory and negative gradation can be obtained.

The silver halide photographic light-sensitive material of the present invention has a light-insensitive top layer on an emulsion layer, the melting time of said light-insensitive top layer being greater than that of said emulsion layer. This yields an effect that, when the light-sensitive material is subjected to a reduction treatment after the formation of an image, a ratio of a decrease in dot area to a decrease in image density is increased; that is, the reduction width is large.

There is no limitation on a reducing solution to be used in the present invention. For example, reducing solutions as described in *The Theory of the Photographic Process*, pp. 738–739, MacMillan (1954), T. Yano, *Shashin Shori—Sono Riron to Jissai (Photographic Processing—its Theory and Practice)*, Kyoritsu Shuppan (1978), Japanese Patent Application (OPI) Nos. 27543/75, 140733/76, 68429/77, 14901/78, 119236/79, 119237/79, 2245/80, 2244/80, 17123/80, 79444/80, 81344/80, and so forth can be used. More specifically, reducing solutions containing oxidizing agents such as permanganates, persulfates, ferric salts, cupric salts, cerium (IV) salts, red prussiate, and perchromates, singly or in combination with each other and, if necessary, further inorganic acids such as sulfuric acid and alcohols, reducing solutions containing oxidizing agents such as red prussiate and iron (III) ethylene-diaminetetraacetate and silver halide solvents such as thiosulfates, rhodanates thioureas, or derivatives thereof and, if necessary, further inorganic acids such as sulfuric acid, and the like can be used.

Typical examples of reducing solutions which can be used in the present invention include a Firmer's reducing solution, iron (III) ethylenediaminetetraacetate, potassium permanganate, an ammonium persulfate reducing solution (Kodak R-5), and a cerium (IV) salt reducing solution.

The light-sensitive material of the present invention for photomecanical process is particularly effective for a reduction treatment using a cerium (IV) salt reducing solution. Thus it has the advantage that the use of a reducing solution containing toxic red prussiate can be avoided.

Such a cerium (IV) salt reducing solution contains a cerium (IV) salt, such as cerium (IV) sulfate, cerium (IV) acetate, ammoniumcerium (IV) nitrate and cerium (IV) nitrate, the amount of said salt being usually from 10 to 130 g and preferably from 20 to 70 g per liter of the reducing solution, an organic or inorganic acid, such as sulfuric acid, nitric acid, phosphoric acid, and acetic acid, the amount of said acid being preferably not more than 1.0 normal per liter of the reducing solution, and, if necessary, further alcohols, glycols, mercapto compounds, surface active agents, tackifiers (e.g., hydroxyethyl cellulose), and the like.

In general, it is preferred that the reduction treatment be completed in from several seconds to ten minutes, particularly several minutes at a temperature of from 10° to 40° C., particularly from 15° to 30° C. If the light-sensitive material for photomechanical process of the present invention is employed, a sufficiently broad reduction width can be obtained under the above-specified conditions.

The reducing solution acts on a silver image formed in the emulsion layer through the light-insensitive top layer containing the compound of the present invention.

The reduction treatment can be performed by various techniques such as a method in which the light-sensitive material for photomechanical process is dipped in a reducing solution, and a method in which a reducing solution is applied on the light-insensitive top layer of the light-sensitive material for photomechanical process by means of, e.g., a writing brush, a brush, and a roller.

The present invention is described in greater detail with reference to the following examples which are not intended to be limiting.

Unless otherwise specified, all percents, ratios, etc. are by weight.

EXAMPLE 1

A single-dispersion silver chlorobromide emulsion (silver chloride content, 70 mol %) having an average grain size of 0.3μ was prepared by a double-jet method, washed with water by the usual procedure, and then subjected to chemical sensitization using sodium thiosulfate and potassium chloroleate. The amount of gelatin contained in the emulsion was 45% by weight based on the weight of silver halide.

A compound of the general formula (I) of the present invention, Compound I-8, was added to the silver chlorobromide emulsion in an amount of $4.5\times10^{-3}$ mol per mol of silver. In addition, 3-ethyl-5-[2-(3-ethyl-2(3H)-thiazolinidene)ethylidene] rhodanine as a sensitizing dye was added and, thereafter, 5-methylbenzotriazole, 4-hydroxy-6-methyl-1,3,3a,7-tetrazaindene, a polyethyl acrylate dispersion, and a 2-hydroxy-4,6-dichloro-1,3,5-triazine sodium salt were added.

To a 5% solution of acid-treated gelatin were added a polymer latex as described in Preparation Example 3 of U.S. Pat. No. 3,525,620, sodium dodecylbenzenesulfonate (surface active agent), and a polymethyl methacrylate latex having an average particle size of 3.0–4.0 microns (matting agent) to prepare a coating solution for a light-insensitive top layer.

The above-prepared coating solutions for the light-sensitive silver halide emulsion layer and the light-insensitive layer were coated on a polyethylene terephthalate support by a two-layer simultaneous coating method. The amount of silver coated was 3.5 g/m$^2$, and the amount of gelatin coated in the light-insensitive top layer was 1.0 g/m$^2$. The thus-obtained light-sensitive material is called "Film No. 1".

A light-sensitive material was produced in the same manner as above except that a polymeric hardening agent P-2 as described above was added to the coating solution for the light-insensitive top layer. This is called "Film No. 2". In Film No. 2, the amount of the polymeric hardening agent P-2 being added was such that the amount of the agent coated was 0.08 g/m$^2$.

These films were then exposed to light through a sensitometry exposure wedge, using a 150-line gray contact screen and, thereafter, developed with a developer having a formulation as shown below at 38° C. for varied periods, 25 seconds, 30 seconds, and 35 seconds, stopped, fixed, washed with water, and dried.

| Developer | Amount (g) |
|---|---|
| Hydroquinone | 40 |
| 4,4-Dimethyl-1-phenyl-3-pyrazolidone | 0.4 |
| Potassium tertiary phosphate | 75 |
| Anhydrous potassium sulfite | 90 |
| Sodium ethylenediaminetetraacetate | 1.0 |
| Potassium bromide | 6 |
| 5-Methylbenzotriazole | 0.6 |
| Water to make | 1 liter |

The pH was adjusted to 11.5 with potassium hydroxide.

The results are shown in Table 1.

TABLE 1

| Film No. | Melting Time (seconds) Emulsion Layer | Melting Time (seconds) Top Layer | 25-Second Development Relative Sensitivity | 25-Second Development γ | 25-Second Development Fog | 30-Second Development Relative Sensitivity | 30-Second Development γ | 30-Second Development Fog | 35-Second Development Relative Sensitivity | 35-Second Development γ | 35-Second Development Fog |
|---|---|---|---|---|---|---|---|---|---|---|---|
| 1 | 700 | 740 | 72 | 8.0 | 0.10 | 100 | 10.5 | 0.15 | 110 | 10.0 | 0.20 |
| 2 | 780 | 1560 | 91 | 10.5 | 0.08 | 123 | 11.0 | 0.11 | 135 | 11.0 | 0.12 |

Note:
The sensitivity is a relative value with the sensitivity of Film No. 1 when developed at 30 seconds as 100.
The melting time is a time required for each layer to melt when the film is dipped in a 0.2 N solution of NaOH maintained at 75° C.

As can be seen from Table 1, Film No. 2 of the present invention is advantageous over Film No. 1 in which the light-insensitive top layer is not subjected to any special hardening in the photographic characteristics of high sensitivity and super contrast can be realized in a shorter developing time and, even if the developing time is lengthened, the performance is maintained and the formation of fog increases less. That is, it is apparent that the film of the present invention has superior developing properties and a broad developing latitude.

A dot strip as prepared by developing each film for 30 seconds was dipped in a cerium reducing solution (20° C.) as shown below and washed with water.

| Reducing Solution | |
|---|---|
| Cerium (IV) sulfate | 25 g |
| Conc. sulfuric acid | 30 g |
| Water to make | 1 liter |

In the thus-reduced dot strip, a change in dot area and a change in density per dot were measured by the use of a microdensitometer. A dot area at the time when a dot of dot area 50% was reduced to a density by the reduction treatment, a reduction time required for this purpose, and a reduction width (the difference between a dot area before the reduction treatment and a dot area after the reduction treatment) are shown in Table 2.

TABLE 2

| Film No. | Before Reduction Dot Area | Before Reduction Dot Density | After Reduction Dot Area | After Reduction Dot Density | Reduction Width |
|---|---|---|---|---|---|
| 1 | 50% | more than 4.0 | 41% | 2.5 | 9% |
| 2 | 50% | more than 4.0 | 35% | 2.5 | 15% |

It can be seen from Table 2 that Film No. 2 of the present invention is greatly improved in reduction performance over Film No. 1 (comparative sample).

EXAMPLE 2

Four single dispersion silver chlorobromide emulsions A to D (average particle size, 0.3μ in all cases), the amount of rhodium salt added and the silver chloride content in each case being as shown in Table 3, were prepared by forming particles in the presence of rhodiumammonium chloride by the double-jet method.

TABLE 3

| Emulsion | Halogen Composition | Rh Content (mol/silver mol) |
|---|---|---|
| A | AgClBr (AgCl = 70 mol %) | 0 |
| B | " | $2 \times 10^{-11}$ |
| C | " | $5 \times 10^{-6}$ |
| D | AgClBr (AgCl = 90 mol %) | $2 \times 10^{-7}$ |

These emulsions were washed with water and chemically sensitized in the same manner as in Example 1. The gelatin content of each emulsion was 45% by weight based on the weight of silver halide.

Using each emulsion, a coating solution for the emulsion layer was prepared in the same manner as in Example 1 except that as the compound of the general formula (I), Compound I-8 was added in an amount of $4.5 \times 10^{-3}$ mol per mol of silver.

A coating solution for the light-insensitive top layer was prepared which had the same formulation as that for Film No. 1 of Example 1.

The two coating solutions as prepared above were coated on a polyethylene terephthalate support by the multilayer simultaneous coating method in such a manner that the amount of silver coated was 3.5 g/m$^2$ and the amount of gelatin coated in the light-insensitive top layer was 1.0 g/m$^2$, and then dried to form Film Nos. 3 to 6 (comparative samples).

Film Nos. 7 to 10 (samples of the present invention) were prepared in the same manner as above except that a polymeric hardener P-2 was added to the coating solution for the light-insensitive top layer. The amount of the polymeric hardening agent P-2 being added was such that the amount of the polymeric hardening agent P-2 being coated was 0.08 g/m$^2$.

Each film was exposed to light in the same manner as in Example 1, developed with a developer having the same formulation as shown in Example 1 at 38° C. for varied times, 10 seconds, 20 seconds, and 30 seconds, and, thereafter, stopped, fixed, washed with water, and dried to obtain a dot strip.

These strips were measured for density. The results are shown in Table 4. Each dot strip (as developed for 20 seconds) was subjected to the same reduction treatment as in Example 1. The reduction width in each case is shown also in Table 4.

TABLE 4

| Film No. | Emulsion | Melting Time (seconds) Emulsion Layer | Melting Time (seconds) Top Layer | Development (38° C.) 10-Second Development Relative Sensitivity | γ | Fog | 20-Second Development Relative Sensitivity | γ | Fog | 30-Second Development Relative Sensitivity | γ | Fog | Reduction Width (%) |
|---|---|---|---|---|---|---|---|---|---|---|---|---|---|
| 3 | A | 700 | 740 | 69 | 3.5 | 0.05 | 100 | 6.5 | 0.08 | 112 | 10.5 | 0.15 | 11 |
| 4 | B | 715 | 740 | 112 | 11.0 | 0.03 | 162 | 16.0 | 0.04 | 209 | 15.0 | 0.05 | 10 |
| 5 | C | 710 | 750 | 76 | 10.0 | 0.03 | 105 | 15.0 | 0.04 | 135 | 15.5 | 0.04 | 12 |
| 6 | D | 700 | 740 | 98 | 10.5 | 0.03 | 145 | 16.0 | 0.04 | 182 | 15.5 | 0.06 | 9 |
| 7 | A | 780 | 1560 | 81 | 5.0 | 0.04 | 105 | 7.5 | 0.07 | 138 | 11.0 | 0.11 | 16 |
| 8 | B | 760 | 1480 | 155 | 14.0 | 0.03 | 195 | 18.0 | 0.04 | 257 | 18.0 | 0.04 | 15 |
| 9 | C | 780 | 1550 | 102 | 11.0 | 0.03 | 129 | 16.0 | 0.04 | 174 | 18.0 | 0.04 | 16 |
| 10 | D | 780 | 1500 | 145 | 13.0 | 0.03 | 178 | 17.0 | 0.04 | 240 | 17.0 | 0.04 | 14 |

It can be seen from Table 4 that Film No. 7 has more superior developing properties and a more broad developing latitude than Film No. 3 and that for Film Nos. 8, 9 and 10 sensitivity can be obtained in a shorter developing time than for Film No. 7 and an increase in fog when the developing time is lengthened is small.

This demonstrates that if, in addition to the light-insensitive top layer of the present invention which is subjected to a special hardening treatment, the silver halide emulsion prepared by adding rhodium salts at the time of particle formation is used, more rapid processing suitability and a more broad developing latitude are realized.

EXAMPLE 3

Two single dispersion silver iodobromide emulsions (silver iodide content=0.1 mol %, average particle size =0.3μ in both cases) having an alternation point as shown in Table 5 were prepared by forming particles in the presence of rhodiumammonium chloride by the double-jet method.

Each emulsion was washed with water and chemically sensitized in the same manner as in Example 1 and then divided. Using each portion, a coating solution for the emulsion was prepared in the same manner as in Example 1 except that the compound of the general formula (I) of the present invention was added in an amount as shown in Table 6.

The same coating solution as that for the light-insensitive top layer of Film No. 1 of Example 1 and the same coating solution (containing the polymeric hardening agent P-2) as that for the light-insensitive top layer of Film No. 2 were prepared.

The coating solutions for the emulsion layer and the light-insensitive top layer were coated in a multi-layer form in combinations as shown in Table 5 and then dried to prepare Film Nos. 11 to 26. In each case, the amount of silver coated was 3.5 g/m$^2$, and the amount of gelatin coated in the light-insensitive top layer was 1.0 g/m$^2$. In Film Nos. 19 to 26, the amount of the polymeric hardening agent P-2 being coated was 0.08 g/m$^2$.

Each film was exposed to light in the same manner as in Example 1, developed with the developer as used in Example 1 at 38° C. for 20 seconds, and, thereafter, stopped, fixed, and washed with water to obtain a dot strip. This dot strip was measured in density. The results are shown in Table 5. A reduction width when each dot strip was subjected to the same reduction treatment as in Example 1 is shown also in Table 5.

TABLE 5

| Film No. | Amount of Rhodium in Emulsion (mol/silver mol) | Compound of General Formula (I) Type | Compound of General Formula (I) Amount Added (mol/silver mol) | Melting Time Emulsion Layer (seconds) | Melting Time Top Layer (seconds) | Photographic Characteristics Relative Sensitivity | γ | Fog | Reduction Width (%) |
|---|---|---|---|---|---|---|---|---|---|
| 11 | 0 | — | 0 | 710 | 740 | 100 | 3.5 | 0.04 | 7 |
| 12 | | I-1 | $2.2 \times 10^{-3}$ | 715 | 750 | 195 | 7.5 | 0.04 | 8 |
| 13 | | I-1 | $4.4 \times 10^{-3}$ | 720 | 750 | 219 | 12.0 | 0.04 | 8 |
| 14 | | I-8 | $4.4 \times 10^{-3}$ | 710 | 740 | 214 | 6.5 | 0.04 | 8 |
| 15 | $2 \times 10^{-7}$ | — | 0 | 700 | 750 | 63 | 4.5 | 0.04 | 8 |
| 16 | | I-1 | $2.2 \times 10^{-3}$ | 720 | 750 | 117 | 10.0 | 0.04 | 9 |
| 17 | | I-1 | $4.4 \times 10^{-3}$ | 710 | 740 | 135 | 15.5 | 0.04 | 8 |
| 18 | | I-8 | $4.4 \times 10^{-3}$ | 705 | 750 | 132 | 10.5 | 0.04 | 8 |
| 19 | 0 | — | 0 | 760 | 1560 | 107 | 4.0 | 0.04 | 14 |
| 20 | | I-1 | $2.2 \times 10^{-3}$ | 750 | 1560 | 209 | 9.2 | 0.04 | 14 |
| 21 | | I-1 | $4.4 \times 10^{-3}$ | 750 | 1560 | 229 | 13.5 | 0.04 | 13 |
| 22 | | I-8 | $4.4 \times 10^{-3}$ | 740 | 1580 | 234 | 8.5 | 0.04 | 14 |
| 23 | $2 \times 10^{-7}$ | — | 0 | 780 | 1560 | 66 | 5.0 | 0.04 | 14 |
| 24 | | I-1 | $2.2 \times 10^{-3}$ | 770 | 1550 | 129 | 12.6 | 0.04 | 13 |
| 25 | | I-1 | $4.4 \times 10^{-3}$ | 770 | 1550 | 145 | 17.2 | 0.04 | 13 |
| 26 | | I-8 | $4.4 \times 10^{-3}$ | 780 | 1570 | 138 | 12.5 | 0.04 | 13 |

It can be seen from Table 5 that the effects of the present invention can be obtained not only by using a silver chlorobromide emulsion, but also by using a silver iodobromide emulsion.

While the invention has been described in detail, and with reference to specific embodiments thereof, it will be apparent to one skilled in the art that various changes and modifications can be made therein without departing from the spirit and scope thereof.

What is claimed is:

1. A silver halide photographic light-sensitive material comprising a support, at least one negative working light-sensitive silver halide emulsion layer on the support, and at least one light-insensitive top layer provided on the emulsion layer, wherein at least one of the emulsion layer and other constituent layers contains a compound represented by the general formula (I)

$$R^1—NHNH—G—R^2 \quad (I)$$

wherein $R^1$ is a substituted or unsubstituted aryl group, $R^2$ is a hydrogen atom, a substituted or unsubstituted aryl group, a substituted or unsubstituted alkyl group, a substituted or unsubstituted alkoxy group, or a substituted or unsubstituted aryloxy group, and G is a carbonyl group, a sulfonyl group, a sulfoxy group, a phosphoryl group, or an N-substituted or unsubstituted imino group and wherein said at least one light-insensitive top layer is hardened so as to have a melting time at least 50 seconds longer than that of the emulsion layer.

2. The material as claimed in claim 1, wherein the at least one light-insensitive top layer having a greater melting time than the emulsion layer is hardened with a polymeric hardening agent.

3. The material as claimed in claim 1, wherein the emulsion layer contains silver halide grains prepared in the presence of a rhodium salt at grain formation or physical ripening.

4. The material as claimed in claim 2, wherein the emulsion layer contains silver halide grains prepared in the presence of a rhodium salt at grain formation or physical ripening.

5. The material as claimed in claim 1, wherein the at least one light-insensitive top layer is hardened so as to have a melting time at least 100 seconds longer than that of the emulsion layer.

6. The material as claimed in claim 1, wherein said at least one light-sensitive silver halide emulsion layer is negative working.

* * * * *